US012790666B2

(12) United States Patent
Li et al.

(10) Patent No.: US 12,790,666 B2
(45) Date of Patent: Nov. 10, 2026

(54) METHOD FOR INCREASING COMPOSITIONAL UNIFORMITY OF ELEMENT Al IN TITANIUM-ALLOY EB INGOT

(71) Applicant: LUOYANG SUNRUI TITANIUM PRECISION CASTING CO., LTD., Luoyang (CN)

(72) Inventors: Bobo Li, Luoyang (CN); Teng Pei, Luoyang (CN); Linfan Jiang, Luoyang (CN); Yinqi Liu, Luoyang (CN); Junjie Zhu, Luoyang (CN); Qiang Li, Luoyang (CN); Nianmin Mao, Luoyang (CN)

(73) Assignee: LUOYANG SUNRUI TITANIUM PREC CASTING CO., LTD., Luoyang (CN)

( * ) Notice: Subject to any disclaimer, the term of this patent is extended or adjusted under 35 U.S.C. 154(b) by 767 days.

(21) Appl. No.: 18/255,015

(22) PCT Filed: Mar. 21, 2022

(86) PCT No.: PCT/CN2022/081925
§ 371 (c)(1),
(2) Date: May 30, 2023

(87) PCT Pub. No.: WO2022/199508
PCT Pub. Date: Sep. 29, 2022

(65) Prior Publication Data

US 2024/0018625 A1 Jan. 18, 2024

(30) Foreign Application Priority Data

Mar. 22, 2021 (CN) ..... 202110303151.4

(51) Int. Cl.
*C22C 1/02* (2006.01)
*C22C 14/00* (2006.01)

(52) U.S. Cl.
CPC ..... *C22C 1/02* (2013.01); *C22C 14/00* (2013.01)

(58) Field of Classification Search
None
See application file for complete search history.

(56) References Cited

U.S. PATENT DOCUMENTS

2016/0069615 A1* 3/2016 Choo ..... F27B 9/40 266/271

FOREIGN PATENT DOCUMENTS

CN 108239710 A 7/2018
CN 113215426 A 8/2021
(Continued)

OTHER PUBLICATIONS

M. Schlienger, Melting Systems for Production of Titanium Ingots and Castings, Sep. 10-14, 1984, Proceedings of the Fifth International Conference on Titanium, p. 15-29 (Year: 1984).*
(Continued)

*Primary Examiner* — Keith D. Hendricks
*Assistant Examiner* — Nikolas Takuya Pullen
(74) *Attorney, Agent, or Firm* — Oliff PLC

(57) ABSTRACT

A method for increasing compositional uniformity of element Al in a titanium-alloy EB ingot includes the following preparation steps: formulating materials, pressing the materials into briquettes with a set shape, arranging the briquettes into an electrode rod material, and feeding the electrode rod material into a feeding chamber for EB melting. The method can effectively resolve such problems as falling, deviation, and blockage of the electrode rod material in the process of switching to a new electrode rod material during melting for
(Continued)

EB ingots, and can significantly improve the stability and uniformity of feeding and melting control in the melting process for titanium-alloy EB ingots, thereby increasing the compositional uniformity of element Al in EB ingots.

6 Claims, 4 Drawing Sheets

(56) References Cited

FOREIGN PATENT DOCUMENTS

| | | | | | |
|---|---|---|---|---|---|
| CN | 113237330 | A | | 8/2021 | |
| CN | 113249588 | A | | 8/2021 | |
| CN | 111036829 | B | * | 2/2022 | ..... C10M 173/02 |
| JP | 2006-346730 | A | | 12/2006 | |
| JP | 2009-095857 | A | | 5/2009 | |

OTHER PUBLICATIONS

May 13, 2022 International Search Report issued in International Patent Application No. PCT/CN2022/081925.

* cited by examiner

METHOD FOR INCREASING COMPOSITIONAL UNIFORMITY OF ELEMENT Al IN TITANIUM-ALLOY EB INGOT

TECHNICAL FIELD

The present invention relates to the technical field of titanium material processing, and specifically, to a method for increasing compositional uniformity of element Al in a titanium-alloy EB ingot.

BACKGROUND

Titanium alloys are widely used in aerospace, ships, weapons and equipment, chemical industries, etc., due to their high specific strength, light weight, and corrosion resistance. The conventional melting method for titanium alloys is vacuum arc remelting (VAR) with a consumable electrode. Raw materials are formulated and blended together and then pressed into an assembled electrode through welding, the electrode is subjected to double or triple VAR processing to obtain a round ingot, and then the round ingot is forged and polished into a square semi-finished product required for rolling into plates. However, this manufacturing method has a long process, a high loss, and a poor high/low-density inclusion removal. Electron-beam (EB) melting is an advanced melting method for titanium alloys to yield large-size flat ingots for direct rolling through a single melting. The method has the advantages of short production process, high production yield, and low production cost, and can effectively remove high/low-density inclusions due to high degree of vacuum and high degree of superheat of molten titanium, resulting in a refining effect.

Al is the most widely used strengthening element added in titanium alloys. In the process of titanium-alloy EB melting, a melt can reach a temperature of 1800-2200° C. and a degree of vacuum of $10^{-2}$ Pa. However, the difference in melting point between Al and Ti is 1000° C., and the difference in saturated vapor pressure between Al and Ti is several times, so Al is very easy to volatilize, causing melting loss. Any discontinuity or fluctuation in the melting process may lead to loss of Al, which makes Al one of the most difficult alloy elements to achieve stable melting loss control and uniformity in the process of titanium-alloy EB melting. In addition, compared with conventional repeated VAR, a method for preparing titanium alloy ingots through a single EB melting with no arc stirring further increases the difficulty of controlling the uniformity of element Al. Therefore, how to increase the uniformity of element Al causes a critical technical bottleneck that urgently needs to be overcome in the current titanium-alloy EB melting. Doing so not only can improve the quality of ingots and materials for subsequent processing, but also have exemplifying and referencing value for increasing compositional uniformity of other alloy elements added in EB ingots.

In the existing melting technology for titanium-alloy EB ingots, briquetting into cylinders and assembling into electrode rod materials through welding that are used in VAR melting are mostly adopted for feeding and melting. In the process of switching to a new electrode rod material that is continuously fed for melting, it is very likely for the tail of the electrode rod material to fall into the molten pool, and the electrode rod material to be fed deviating outside of the melting pattern region, even causing material blockage, which affects the melting rate and the feeding consistency and stability, and further leads to the melting loss of element Al and reduces the compositional uniformity of element Al. Moreover, in the melting process of titanium-alloy EB ingots, there is a certain time interval while an electrode rod material is being switched, which may cause dry burning of the molten pool by electron beams during the switching interval and a sudden flow increase after switching, further affecting the compositional uniformity of element Al in EB ingots. This requires improvement.

SUMMARY

In view of deficiencies in the related art, an objective of the present invention is to provide a method for increasing compositional uniformity of element Al in a titanium-alloy EB ingot. This method can effectively resolve such problems as falling, deviation, and blockage of the electrode rod material in the process of switching to a new electrode rod material during melting for EB ingots, and can significantly improve the stability and uniformity of feeding and melting control in the melting process for titanium-alloy EB ingots, thereby increasing the compositional uniformity of element Al in EB ingots.

The technical solutions adopted by the present invention to resolve the above technical problem are as follows. The present invention provides a method for increasing compositional uniformity of element Al in a titanium-alloy EB ingot, including the following preparation steps:

- step 1: weighing titanium sponge and a required intermediate alloy out in a formulation ratio to a total weight of 80-200 kg for each blending unit;
- step 2: adding the raw materials weighed out in step 1 in each blending unit into a blender to mix uniformly for no less than 250-350 s; and transporting the mixed materials in each blending unit from an outlet of the blender to a cavity of a briquetting mold through a conveyor belt;
- step 3: pressing the mixed materials into a briquette with a set shape on a hydraulic oil press, where the briquette includes a Z-shaped briquette body, a top portion of a front end of the briquette body protrudes outward to form an upper convex portion, a top portion of a rear end of the briquette body is recessed inwardly to form an upper concave portion matching the upper convex portion, and two adjacent briquette bodies can form a staggered fit together by attaching the upper convex portion to the upper concave portion;
- step 4: arranging a plurality of briquettes pressed in step 3 in sequence in a length direction to obtain an electrode rod material;
- step 5: feeding the electrode rod material obtained in step 4 into a feeding chamber;
- step 6: positioning and preheating the electrode rod material in the feeding chamber through electron beams, and EB melting a front end of the electrode rod material moving forward at a constant speed in an automated horizontal feeding mode; and
- step 7: quickly pushing, when the electrode rod material is melted to 50-200 mm before a limit position of a pushing rod and needs to be switched to a next electrode rod material, the electrode rod material to the limit position manually to engage the next electrode rod material with a molten end of the electrode rod material, resuming the melting in the automated horizontal feeding mode, and repeating this operation when the electrode rod material needs to be switched, until the melting is completed.

Further, both the upper convex portion and the upper concave portion have rounded corners at a junction, and the rounded corner on the upper concave portion is larger than the rounded corner on the upper convex portion.

Further, the upper convex portion and the upper concave portion have an equal length of 40-120 mm and an equal thickness of 40-200 mm.

Further, in step 4, the briquettes are arranged in the following manner: two adjacent briquette bodies can form a staggered fit together by attaching the upper convex portion to the upper concave portion, the upper convex portion and the upper concave portion are compacted and centered by a clamp at a fitting region, and are welded together on each surface at the joining seam by a plasma welding machine with no less than 3-4 welding spots.

Further, in step 6, the electrode rod material is melted in the following process: the electrode rod material is pushed forward at the constant speed in the automated horizontal feeding mode, when the electrode rod material is pushed from a feeding roller conveyor to a support plate by the pushing rod, the front end of the electrode rod material is melted through the electron beams, and the molten titanium flows into a cooling bed.

Further, in step 7, the electrode rod material is switched by the following manner: the upper convex portion of the next electrode rod material is compacted to the upper concave portion of the molten end of the electrode rod material, and the melting of the electrode rod material is fully and continuously carried out at an electron-beam melting region during the switching of the electrode rod material.

The present invention has the following beneficial effects: In the present invention, by innovating the shape design of the briquette and electrode rod material and optimizing the process of switching the electrode rod material, the stability of the melting process for titanium-alloy EB ingots is improved, thereby effectively increasing the compositional uniformity of element Al in EB ingots. The beneficial effects are specifically shown as follows.

1. The mixed materials are continuously and evenly discharged inchingly in small batches and transported into the cavity of the briquetting mold at a constant speed through the conveyor belt, which avoids segregation and separation of the mixed alloy components caused by discharge in whole and manual transportation and dumping, and improves the uniformity of raw materials in preparation, thereby promoting the compositional uniformity of Al and other elements in EB ingots after melting.
2. Compared with cylindrical briquettes used in conventional VAR melting, the electrode rod material of the present invention is fed straightly and stably as the contact area between the bottom of the electrode rod material and the feeding roller conveyor is greatly increased, which effectively avoids common abnormalities such as deviation and blockage of the electrode rod material, and improves the stability and continuity of feeding and melting of the electrode rod material, thereby making the melting loss of Al uniform and consistent throughout the continuous titanium-alloy EB melting process, and increasing the uniformity of element Al in EB ingots.
3. The briquettes and the assembled electrode rod material through welding are designed innovatively. The longitudinal section of the briquette is Z-shaped as a whole, and two adjacent briquette bodies can form a staggered fit together by attaching the upper convex portion to the upper concave portion. The electrode rod materials are engaged with each other. At a later stage of the melting of an electrode rod material, the tail part of a front electrode rod material will not fall into the molten pool due to the engagement of a next electrode rod material with the tail part of the front electrode rod material, so that even feeding and melting can be ensured in the process of electrode rod material switching and melting, which addresses the common falling issue of conventionally used cylindrical briquettes and electrode rod materials, and overcomes the resulting technical bottleneck of feeding and melting fluctuations, and melting loss of element Al, thereby increasing the uniformity of element Al in EB ingots.
4. In the conventional melting process, the feeding speed remains unchanged when the electrode rod material is switched, while it takes time for the pushing rod to reset and for a next electrode rod material to be transported to the pushing rod, during which electron beams have no material to melt and can only dry-burn the molten pool to maintain the temperature of the molten titanium. After that, the electron beams continue to melt a switched electrode rod material. This leads to inconsistency in the entire melting process, and further causes the melting loss of element Al. In the present invention, by optimizing the process of switching the electrode rod material, the uniformity of melting raw materials can be achieved in the process of switching the electrode rod material, so that the melting loss of Al is uniform and consistent throughout the whole titanium-alloy EB melting process, thereby increasing the uniformity of element Al in ingots.
5. Element Al is one of the most difficult alloy elements to achieve stable melting loss control and uniformity in the process of titanium-alloy EB melting. Therefore, in the present invention, not only the uniformity of Al can be increased, but also the uniformity of other alloy elements common in titanium alloys, such as V, Sn, Mo, Zr, Fe, and Nb, can be increased.

Figure 1:
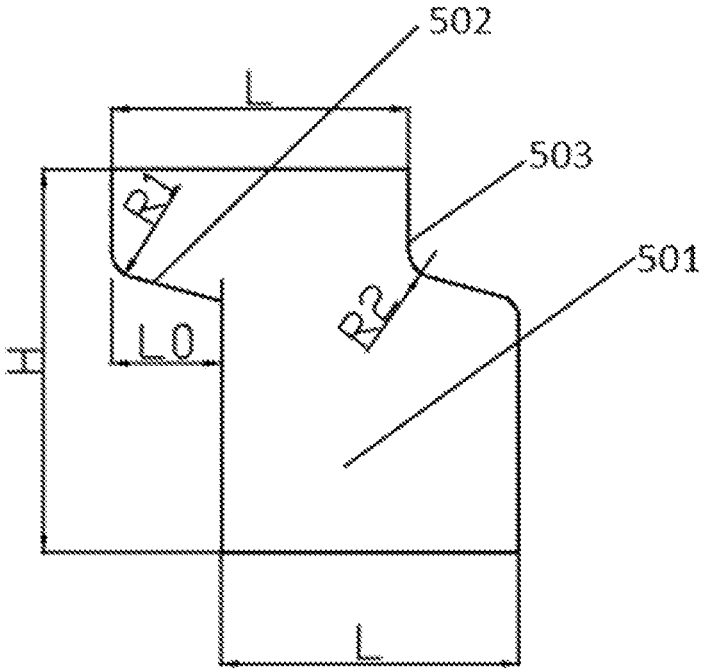
FIG. 1 is a schematic structural diagram of a briquette in Example 1 according to the present invention.

In the accompanying drawings: 1. Cooling bed; 2. Molten titanium; 3. Electron beam; 4. Molten end; 5. Electrode rod material; 501. Briquette body; 502. Upper convex portion; 503. Upper concave portion; 6. Welding spot; 7. Pushing rod; 8. Feeding roller conveyor; and 9. Support plate.

DETAILED DESCRIPTION

The embodiments of the present invention are described in detail with reference to the accompanying drawings. The embodiments are implemented on the premise of the technical solutions of the present invention, and a detailed implementation and a specific operation process are given. However, the protection scope of the present invention is not limited to the following embodiments.

With reference to the accompanying drawings, a method for increasing compositional uniformity of element Al in a titanium-alloy EB ingot includes the following preparation steps:

Step 1: Weigh titanium sponge and a required intermediate alloy out in a formulation ratio to a total weight of 80-200 kg for each blending unit.

Step 2: Add the raw materials weighed out in step 1 in each blending unit into a blender to mix uniformly for no less than 250-350 s; and transport the mixed materials in each blending unit from an outlet of the blender to a cavity of a briquetting mold through a conveyor belt at a constant speed. The outlet of the blender is controlled by a pneumatic valve to continuously and evenly discharge the material inchingly in small batches.

Step 3: Press the mixed materials into a briquette with a set shape on a hydraulic oil press of no less than 2000 tons, where the briquette includes a Z-shaped briquette body 501, a top portion of a front end of the briquette body protrudes outward to form an upper convex portion, a top portion of a rear end of the briquette body is recessed inwardly to form an upper concave portion matching the upper convex portion, the briquette body 501 presents a Z-shaped structure, and two adjacent briquette bodies can form a staggered fit together by attaching the upper convex portion to the upper concave portion. The upper convex portion and the upper concave portion have an equal length of 40-120 mm and an equal thickness of 40-200 mm.

Step 4: Arrange a plurality of briquettes pressed in step 3 in sequence in a length direction to obtain an electrode rod material 5. The briquettes are arranged in the following manner: two adjacent briquette bodies 501 can form a staggered fit together by attaching the upper convex portion to the upper concave portion, the upper convex portion and the upper concave portion are compacted and centered by a clamp at a fitting region, and are welded together on each surface at the joining seam by a plasma welding machine with no less than 3-4 welding spots 6.

Two adjacent briquettes can form a staggered fit together by attaching the upper convex portion to the upper concave portion. The electrode rod materials are engaged with each other. At a later stage of the melting of an electrode rod material, the tail part of a front electrode rod material will not fall into the molten pool due to the engagement of a next electrode rod material with the tail part of the front electrode rod material, so that even feeding and melting can be ensured in the process of electrode rod material switching and melting, which addresses the common falling issue of conventionally used cylindrical briquettes and electrode rod materials, and overcomes the resulting technical bottleneck of feeding and melting fluctuations, and melting loss of element Al, thereby increasing the uniformity of element Al in EB ingots.

Step 5: Feed the electrode rod material 5 obtained in step 4 into a feeding chamber.

Step 6: Position and preheat the electrode rod material 5 in the feeding chamber through electron beams 3, and EB melt a front end of the electrode rod material 5 moving forward at a constant speed in an automated horizontal feeding mode by an electron gun pattern process. The electrode rod material 5 is melted in the following process: the electrode rod material 5 is pushed forward at the constant speed in the automated horizontal feeding mode, when the electrode rod material 5 is pushed from a feeding roller conveyor 8 to a support plate 9 by a pushing rod 7, the front end of the electrode rod material 5 is melted through the electron beams 3, and the molten titanium 2 flows into a cooling bed 1.

Step 7: Quickly push, when the electrode rod material 5 is melted to 50-200 mm before a limit position of a pushing rod 7 and needs to be switched to a next electrode rod material 5, the electrode rod material 5 to the limit position manually to engage the next electrode rod material 5 with a molten end 4 of the electrode rod material 5, resume the melting in the automated horizontal feeding mode, and repeat this operation when the electrode rod material 5 needs to be switched, until the melting is completed. The electrode rod material 5 is switched by the following manner: the upper convex portion 502 of the next electrode rod material 5 is compacted to the upper concave portion 503 of the molten end 4 of the electrode rod material 5, and the melting of the electrode rod material 5 is fully and continuously carried out at an electron-beam 3 melting region during the switching of the electrode rod material 5.

The briquette has a total weight up to 200 kg and has a width W, a height H, and a length L. The longitudinal section of the briquette is Z-shaped as a whole. A plurality of briquettes can form a staggered fit together by attaching the upper convex portion 6 to the upper concave portion 7. Both the upper convex portion at a top portion of the front end and the upper concave portion at a top portion of the rear end have a length L0 and a thickness h, and have two rounded corners of R1 and R2 respectively at two junctions.

The width W is defined to leave a gap of 20-70 mm on a width of the feeding roller conveyor. The height H is determined according to a height of a feeding inlet and a weight of the briquette. The length L is determined according to the weight of the briquette. The upper convex portion 6 and the upper concave portion 7 have an equal length L0 of 40-120 mm. The upper convex portion 6 and the upper concave portion 7 have an equal thickness h of 40-200 mm. The inner concave rounded corner R1 is set to 20-50 mm, and the outer convex rounded corner R2 is 5-10 mm larger than R1.

Example 1

Step 1: Titanium sponge, an AlV intermediate alloy, Al granules, and a ferro-titanium alloy were weighed out in formulation proportions of Al=7.5%, V=4.0%, and Fe=0.15% to a total weight of 80 kg for each blending unit.

Step 2: The raw materials weighed out in step 1 in each blending unit were added into a blender automatically or manually to mix uniformly for 300 s; and the mixed materials in each blending unit were transported from an outlet of the blender to a cavity of a briquetting mold through a conveyor belt at a constant speed. The outlet of the blender was controlled by a pneumatic valve to continuously and evenly discharge the material inchingly in small batches.

Step 3: The mixed materials were pressed into a Z-shaped briquette on a hydraulic oil press of no less than 2000 tons, where the briquette included a briquette body, a top portion of a front end of the briquette body protruded outward to form an upper convex portion, a top portion of a rear end of the briquette body was recessed inwardly to form an upper concave portion matching the upper convex portion, two adjacent briquette bodies can form a staggered fit together by attaching the upper convex portion to the upper concave portion, and the upper convex portion and the upper concave portion had an equal length of 40 mm.

Step 4: Every 5 briquettes pressed in step 3 were arranged in sequence in a length direction, an upper convex portion of a briquette was pressed against an upper concave portion of a front briquette, and the upper convex portion and the upper concave portion were compacted and centered by a clamp and were welded together on each surface at the joining seam by a plasma welding machine with 3 welding spots.

Step 5: The welded electrode rod material was fed into a feeding chamber.

Step 6: The electrode rod material was positioned and preheated through electron beams, and a front end of the electrode rod material moving forward at a constant speed in an automated horizontal feeding mode was EB-melted by an electron gun pattern process.

Figure 2:
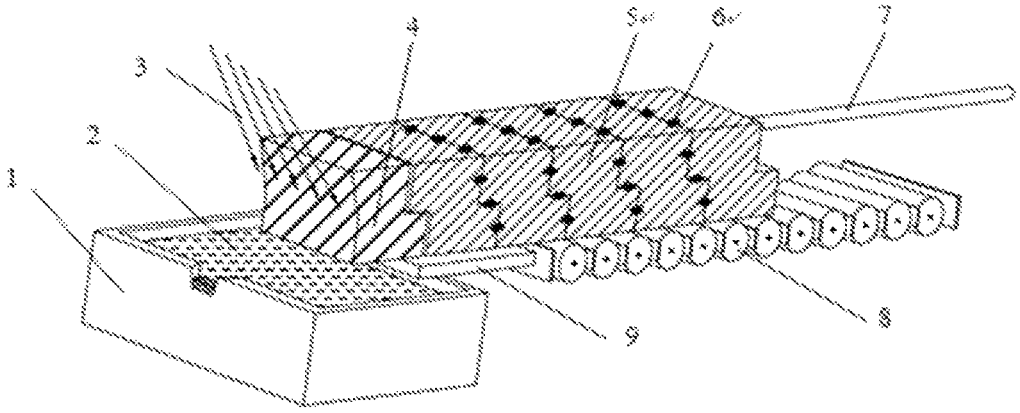
FIG. 2 is a schematic structural diagram of melting of an electrode rod material in Example 1 according to the present invention.

Step 7: When the electrode rod material was melted to 50 mm before a limit position of a pushing rod and needed to be switched to a next electrode rod material, the electrode rod material was quickly pushed to the limit position manually, so as to carry out the melting fully and continuously at an electron-beam melting region at the front end during the 4 minutes of switching of the electrode rod material. After the next electrode rod material was pushed in place and engaged with the tail of the front electrode rod material as shown in FIG. 2, the melting was continued in the automated horizontal feeding mode. This operation was repeated when the electrode rod material needed to be switched until the melting was completed. After face milling and sawing, a TC4 titanium-alloy EB ingot with a normal size of 190*1065*5800 mm was obtained. The ingot was sampled and analyzed for the content of element Al, and the results were shown in Table 1.

Figure 3:
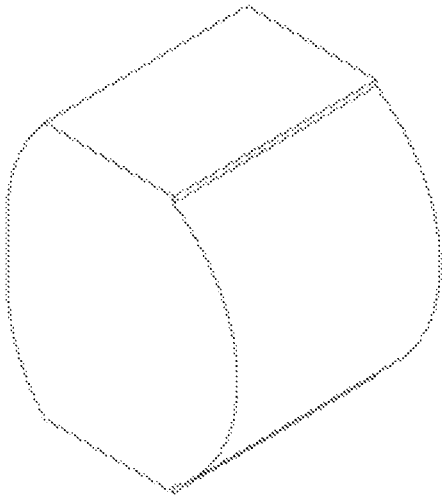
FIG. 3 is a schematic structural diagram of a briquette in Comparative Example 1.
Figure 4:
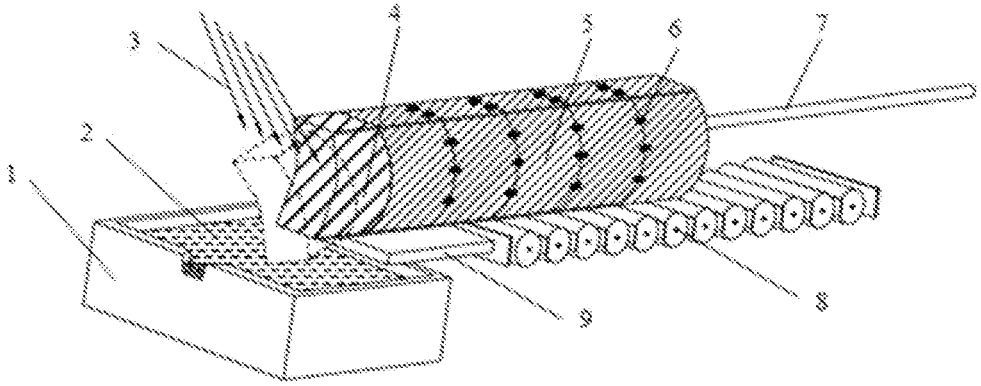
FIG. 4 is a schematic structural diagram of melting of an electrode rod material in Comparative Example 1.

Comparative Example 1: The same materials were pressed into a cylindrical TC4 titanium-alloy briquette as shown in FIG. 3, and the briquettes were assembled to prepare an electrode rod material through welding. The electrode rod material was pushed forward at a constant speed in an automated feeding mode throughout the whole melting process for EB ingots. When there was a need to switch the electrode rod material, the electrode rod material still moved forward in the automated feeding mode, without the operation of switching the electrode rod material in step 7 in Example 1, until the melting was completed and an ingot was obtained. The ingot was sampled and analyzed for the content of element Al, and the results were also shown in Table 1.

TABLE 1

Results of element Al in TC4 titanium-alloy EB ingots (wt %)

| Length/mm | 500 | 1000 | 1500 | 2000 | 2500 | 3000 | 3500 | 4000 | 4500 | 5000 | 5500 |
|---|---|---|---|---|---|---|---|---|---|---|---|
| Example 1 | 6.06 | 6.10 | 6.18 | 6.23 | 6.12 | 6.18 | 6.08 | 6.22 | 6.26 | 5.97 | 6.01 |
| Comparative Example 1 | 6.03 | 6.20 | 6.27 | 6.46 | 5.79 | 6.04 | 5.92 | 6.07 | 6.25 | 5.69 | 6.22 |

In the TC4 titanium-alloy EB ingot obtained in Example 1, the minimum content of Al is 5.97%, and the maximum content of Al is 6.23%, with a compositional deviation of 0.26%. In the TC4 titanium-alloy EB ingot obtained in Comparative Example 1, the minimum content of Al is 5.69%, and the maximum content of Al is 6.46%, with a compositional deviation of 0.77%. Based on this, it indicates that the compositional uniformity of element Al in the EB ingot prepared in Example 1 is significantly higher than that in Comparative Example 1.

As the contact area between the bottom of the electrode rod material and the feeding roller conveyor is greatly increased in Example 1, the electrode rod material is fed straightly and stably, effectively avoiding abnormalities such as deviation and blockage of the electrode rod material; the electrode rod material consisting of Z-shaped briquettes is used in Example 1, which can ensure that the tail part of a front electrode rod material will not fall into the molten pool. In addition, in Example 1, the process of switching the electrode rod material is optimized, avoiding dry burning of the molten titanium by electron beams in the conventional switching process, and achieving the uniformity of melting raw materials in the process of switching the electrode rod material. Based on the improvements in the above aspects, continuous and stable feeding, melting, and switching in the melting process for titanium-alloy EB ingots can be achieved, so that the melting loss of Al in the molten titanium is uniform and consistent throughout the whole melting process, thereby increasing the uniformity of element Al in EB ingots.

In Comparative Example 1, as the used electrode rod material consisting of conventional cylindrical briquettes has a small contact area at the bottom and flat head and tail parts, abnormalities such as deviation, blockage, and falling of the electrode rod material frequently occur in the actual melting process, and the molten titanium is dry-burned by electron beams in the process of switching the electrode rod material, which leads to discontinuous and unstable feeding, melting, and switching throughout the whole melting process for titanium-alloy EB ingots, and large fluctuations in the melting loss of element Al in the molten titanium, resulting in poor uniformity of element Al in titanium-alloy EB ingots.

It is to be noted that, in this specification, the relational terms such as I, II, and III are used only to differentiate an entity or operation from another entity or operation, and do not require or imply any actual relationship or sequence between these entities or operations. Moreover, the terms "include", "comprise", and any variation thereof are intended to cover a non-exclusive inclusion. Therefore, in the context of a process, a method, an object, or a device that includes a series of elements, the process, method, object, or device not only includes such elements, but also includes other elements not specified expressly, or may include inherent elements of the process, method, object, or device. Unless otherwise specified, an element limited by "include a/an . . . " does not exclude other same elements existing in the process, method, object, or device that includes the elements.

The invention claimed is:

1. A preparation method for increasing compositional uniformity of elemental Al in a titanium-alloy electron beam (EB) ingot, comprising the following preparation steps:

step 1: weighing a titanium sponge and an intermediate alloy in a formulation ratio to a total weight of 80-200 kg;

step 2: adding the titanium sponge and the intermediate alloy weighed out in step 1 into a blender to mix uniformly for no less than 250 s; and transporting the mixed materials from an outlet of the blender to a cavity of a briquetting mold through a conveyor belt;

step 3: pressing the mixed materials into a Z-shaped briquette on a hydraulic oil press, wherein the Z-shaped briquette comprises a top portion of a front end that protrudes outward to form an upper convex portion, a top portion of a rear end that is recessed inwardly to form an upper concave portion matching the upper convex portion, and two adjacent Z-shaped briquettes form a staggered fit together by attaching the upper convex portion of one of the two adjacent Z-shaped briquettes to the upper concave portion of a second one of the two adjacent Z-shaped briquettes;

step 4: arranging a plurality of Z-shaped briquettes pressed in step 3 in sequence in a length direction to obtain an electrode rod material;

step 5: feeding the electrode rod material obtained in step 4 into a feeding chamber;

step 6: positioning and preheating the electrode rod material in the feeding chamber through electron beams, and EB melting a front end of the electrode rod material while moving forward at a constant speed in an automated horizontal feeding mode;

step 7: pushing, when the electrode rod material is melted to 50-200 mm before a limit position of a pushing rod at which the electrode rod material needs to be switched to a next electrode rod material, the electrode rod material to the limit position manually to engage the next electrode rod material with a molten end of the electrode rod material, resuming the melting in the automated horizontal feeding mode; and repeating step 7 until the melting is completed.

2. The preparation method for increasing compositional uniformity of elemental Al in a titanium-alloy EB ingot according to claim 1, wherein both the upper convex portion and the upper concave portion have rounded corners at a junction, and the rounded corner on the upper concave portion is larger than the rounded corner on the upper convex portion.

3. The preparation method for increasing compositional uniformity of elemental Al in a titanium-alloy EB ingot according to claim 2, wherein the upper convex portion and the upper concave portion have an equal length of 40-120 mm and an equal thickness of 40-200 mm.

4. The preparation method for increasing compositional uniformity of elemental Al in a titanium-alloy EB ingot according to claim 3, wherein in step 4, the Z-shaped briquettes are arranged in the following manner: the two adjacent Z-shaped briquettes form the staggered fit together by attaching the upper convex portion of the one of the two adjacent Z-shaped briquettes to the upper concave portion of the second one of the two adjacent Z-shaped briquettes, the upper convex portion and the upper concave portion are compacted and centered by a clamp at a fitting region, and are welded together on each surface at a joining seam by a plasma welding machine with no less than 3 welding spots.

5. The preparation method for increasing compositional uniformity of elemental Al in a titanium-alloy EB ingot according to claim 1, wherein in step 6, the electrode rod material is melted in the following process: the electrode rod material is pushed forward at the constant speed in the automated horizontal feeding mode, and when the electrode rod material is pushed from a feeding roller conveyor to a support plate by the pushing rod, the front end of the electrode rod material is melted through the electron beams, and molten electrode rod material flows into a cooling bed.

6. The preparation method for increasing compositional uniformity of elemental Al in a titanium-alloy EB ingot according to claim 1, wherein in step 7, the electrode rod material is switched by the following manner: the upper convex portion of the next electrode rod material is compacted to the upper concave portion of the molten end of the electrode rod material, and the melting of the electrode rod material is fully and continuously carried out at an electron-beam melting region during the switching of the electrode rod material.

* * * * *